US009090431B2

(12) United States Patent
Partee

(10) Patent No.: US 9,090,431 B2
(45) Date of Patent: Jul. 28, 2015

(54) WIRE WRAPPER AND A METHOD OF USE THEREOF

(75) Inventor: Jimmie Paul Partee, Double Oak, TX (US)

(73) Assignee: ATC LOGISTICS & ELECTRONICS, INC., Fort Worth, TX (US)

( * ) Notice: Subject to any disclaimer, the term of this patent is extended or adjusted under 35 U.S.C. 154(b) by 438 days.

(21) Appl. No.: 13/367,028

(22) Filed: Feb. 6, 2012

(65) Prior Publication Data

US 2013/0200198 A1 Aug. 8, 2013

(51) Int. Cl.
*B65H 54/58* (2006.01)
*B65H 54/62* (2006.01)

(52) U.S. Cl.
CPC ..... *B65H 54/58* (2013.01); *B65H 54/62* (2013.01); *B65H 2701/34* (2013.01)

(58) Field of Classification Search
CPC ..... B65H 54/58; B65H 54/62; B65H 2701/34
USPC ..... 242/472.5, 388.1, 360, 362, 362.2, 242/362.3, 363, 390, 390.8, 398, 402, 242/476.1, 476.6, 486.9, 487, 473.4, 579, 242/587, 587.2, 597, 597.1, 597.5, 242/613–613.1
See application file for complete search history.

(56) References Cited

U.S. PATENT DOCUMENTS

| | | | | |
|---|---|---|---|---|
| 3,606,183 | A * | 9/1971 | Turk | 242/414.1 |
| 7,128,291 | B1 * | 10/2006 | Schanke et al. | 242/533.7 |
| 7,374,124 | B2 * | 5/2008 | Engelsher | 242/390.8 |
| 8,672,254 | B2 * | 3/2014 | Smith | 242/472.5 |
| 2011/0089285 | A1 * | 4/2011 | Chambers et al. | 242/608.4 |
| 2012/0056030 | A1 * | 3/2012 | Shogren | 242/476.1 |

* cited by examiner

*Primary Examiner* — William E Dondero
(74) *Attorney, Agent, or Firm* — McGuireWoods, LLP

(57) ABSTRACT

A wire wrapper including a drum configured to rotate. The drum includes one or more slits for receiving a wire. The wire wrapper further includes a motor configured to rotate the drum to wrap the wire around the drum. The wire wrapper further includes a controller configured to start and stop the motor in response to user input.

16 Claims, 3 Drawing Sheets

WIRE WRAPPER AND A METHOD OF USE THEREOF

BACKGROUND

The use of and development of communications has grown nearly exponentially in recent years. The growth is fueled by larger networks with more reliable protocols and better communications hardware available to both service providers and consumers. New electronic devices, such as laptops, tablets (e.g. iPads), wireless handsets, personal digital assistants (PDAs), computers, laptops, e-Readers, music players, global positioning systems, and other similar devices are being released nearly constantly.

In many cases, electronic devices come with any number of power cords, mobility cables, chargers, wired adapters, communications cables, or other types of wires (hereinafter referred to as "wire" or "wires"). Wrapping up wires, whether new or used, may be time consuming and may difficult to do consistently for different sizes and lengths of cables.

SUMMARY

One embodiment provides a wire wrapper including a drum configured to rotate. The drum may include one or more slits for receiving a wire. The wire wrapper further includes a motor configured to rotate the drum to wrap the wire around the drum. The wire wrapper may further include a controller configured to start and stop the motor in response to user input.

Another embodiment provides a wire wrapper. The wire wrapper may include a drum configured to rotate. The drum may include one or more slits for receiving a wire. The drum may include a biased catch for sliding the wire toward an open end of the drum once the wire is wrapped. The wire wrapper may further include a motor configured to rotate the drum to wrap the wire around the drum. The wire wrapper may further include a controller configured to start and stop the motor in response to a first user selection and a second user selection, respectively.

Yet another embodiment provides a method for wrapping a wire. The wire to be wrapped may be received through one or more slits of a drum. A first user selection may be received to activate a motor attached to the drum. The drum may be rotated. Rotation of the drum may be stopped in response to a second user selection.

BRIEF DESCRIPTION OF THE DRAWINGS

Illustrative embodiments of the present invention are described in detail below with reference to the attached drawing figures, which are incorporated by reference herein and wherein.

DETAILED DESCRIPTION OF THE DRAWINGS

The illustrative embodiments provide a wire wrapper and a method of utilizing the wire wrapper. In one embodiment, the wire wrapper may include a drum driven by a motor to wrap the wire. The wire wrapper may be controlled by a user or operator to wrap up new or used wires. The motor of the wire wrapper may be driven by a power cord or battery. The wire wrapper may be fixed or portable. For example, the wire wrapper may be attached to a test bench by screws for stability and ease of use.

Components of the wire wrapper may be interchangeable for different sizes of wires. The size of wire refers to the gauge, length, and end type. For example, the drum may be interchanged for wrapping wires in a bundle to a pre-defined diameter. The wire wrapper may be controlled by a foot pedal, hand switch, knob, pressure plate, voice control or other control device. For example, a foot pedal may include an on/off switch and may be activated or deactivated to start the motor and then stop the motor. In one embodiment, the motor is a DC motor and the drum is tapered toward an open end. The drum is rotationally attached or coupled to the motor. The motor may be attached to a support that is perpendicularly connected to a base plate. Both the support and the base plate stabilize the wire wrapper during use.

In one embodiment, the wire is manually removed from the drum by the user before or after bundling the wire (i.e. tie wrap, plastic wrap, clip, etc). In another embodiment, the wire wrapper may include a manual or automatic release mechanism. For example, the release mechanism may include a biased catch within the drum that moves the wire toward the open end in response to user input, such as a handle attached to the catch being turned, a button activated, or another user selection.

Figure 1:
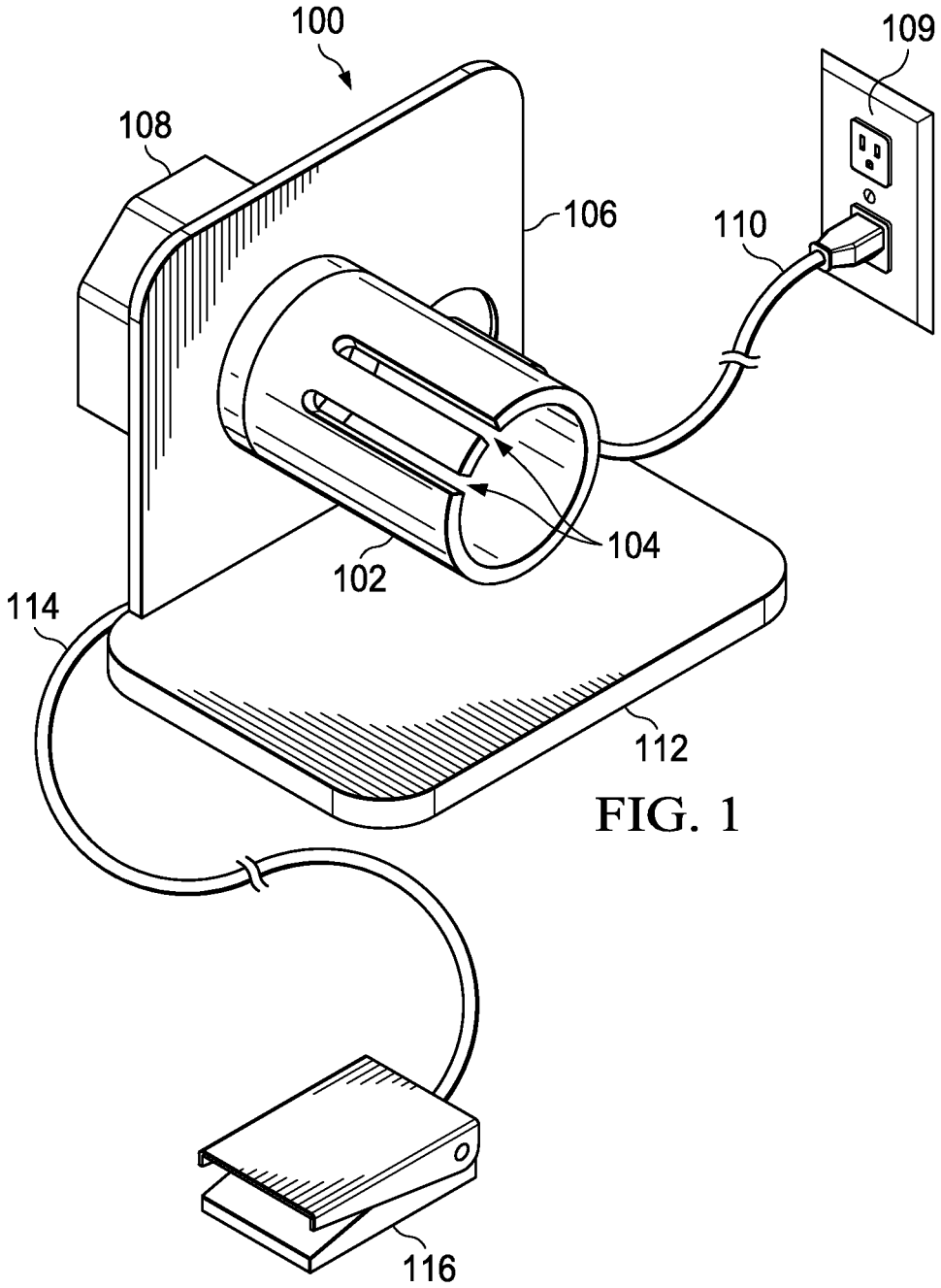
FIG. 1 is a pictorial representation of a wire wrapper in accordance with an illustrative embodiment.

FIG. 1 is a pictorial representation of a wire wrapper 100 in accordance with an illustrative embodiment. The wire wrapper 100 may include any number of components and configurations that may be combined and intermixed utilizing any of the illustrative embodiments or examples. In one embodiment, the wire wrapper 100 may include a drum 102, slits 104, a support 106, a motor 108, a power cable 110, a base plate 112, a control cable 114, and a foot pedal 116.

In one embodiment, the motor is a direct current (DC) motor. The motor 108 may include one or more gears, belts, inverters, and amplifiers as are known in the art. The motor 108 may be geared to run at a selected revolution per minute (RPM). In one embodiment, the gear ratio is 1:1 and the output speed is 108 rpm. However, the gear ratio and output speed may vary based on the type and size of wire and user preference. In another embodiment, the gears (not shown) may be interchangeable for selecting a desired rate of rotation.

The motor 108 may be driven in a wrapping or on mode by alternating current from an outlet 109 that is inverted and communicated to the motor 108 through the power cable 110. Alternatively, the motor 108 may be powered by a battery (not shown). The motor 108 is a DC motor, however, in other embodiments, an AC motor, electromagnets, a hand crank, foot drive, or other drive system may be utilized to rotate the drum 102.

The operation of the motor 108 may be controlled by the foot pedal 116 through the control cable 114. The foot pedal 116 is a user interface for controlling the operation of the motor 108. In one embodiment, the foot pedal 116 changes the operation of the motor between off and on (wrapping) state or mode. For example, the foot pedal 116 may include an on-off switch for activating and deactivating the motor 108 (i.e. providing and removing power to the motor 108). In another embodiment, the foot pedal 116 may proportionally increase or decrease the power provided to the motor 108 corresponding to the position or pressure exerted on the foot pedal 116 for more quickly wrapping a wire. The foot pedal 116 may include a cowling or housing for stabilizing the foot pedal 116 during utilization.

The motor 108 may attach to the support 106 for stabilizing the motor 108 and drum 102 during rotation. In one embodiment, the support 106 is an extension for separating the drum 102 from a work area, such as a bench or table. The support 106 may be perpendicularly attached to the base plate 112. The base plate 112 is a stabilizing base of the wire wrapper 100. The base plate 112 may be weighted or made of metal to support the wire wrapper 100 during operation. However, the support 106 and base plate 112 may be formed of any material strong enough to support torque induced by the motor 108 during the wrapping process. In addition, the support 106 and base plate 112 may take any number of shapes. For example, the support 106 of the wire wrapper 100 may extend from a wall or attach to a test fixture eliminating the need for the base plate 112. The base plate 112 may include holes (not shown) or flanges with holes for connecting the base plate 112 to a table or other fixture utilizing screws, bolts, clamps, or other attachment mechanisms. For example, the base plate 112 may also include brackets, suction cups, clamps, or Velcro.

The motor 108 is rotationally attached or coupled to the drum 102 for driving the rotation of the drum 102. In one embodiment, the drum 102 may attach to the motor utilizing a nut and bolt configuration, coupler, pin, or other locking mechanism. For example, the drum 102 may include a nut that screws onto a drive shaft of the motor 108 for driving the drum 102. In one embodiment, the wire wrapper 100 may include a locking button for the motor 108 that secures one or more gears of the wire wrapper 100. For example, once the locking button is selected the user may spin the drum 102 off of the drive shaft of the motor 108. One or more locking buttons may also engage a square nut of the drum 102 or the other components of the wire wrapper 100.

In one embodiment, the drum 102 is a hollow cylinder around which a wire is wrapped. The drum 102 is attached at a first end to the motor 108 and is open at a second end. The drum 102 may be tapered from wider at the first end to narrower at the second or open end for easily removing the wire once wrapped around the drum 102.

Figure 2:
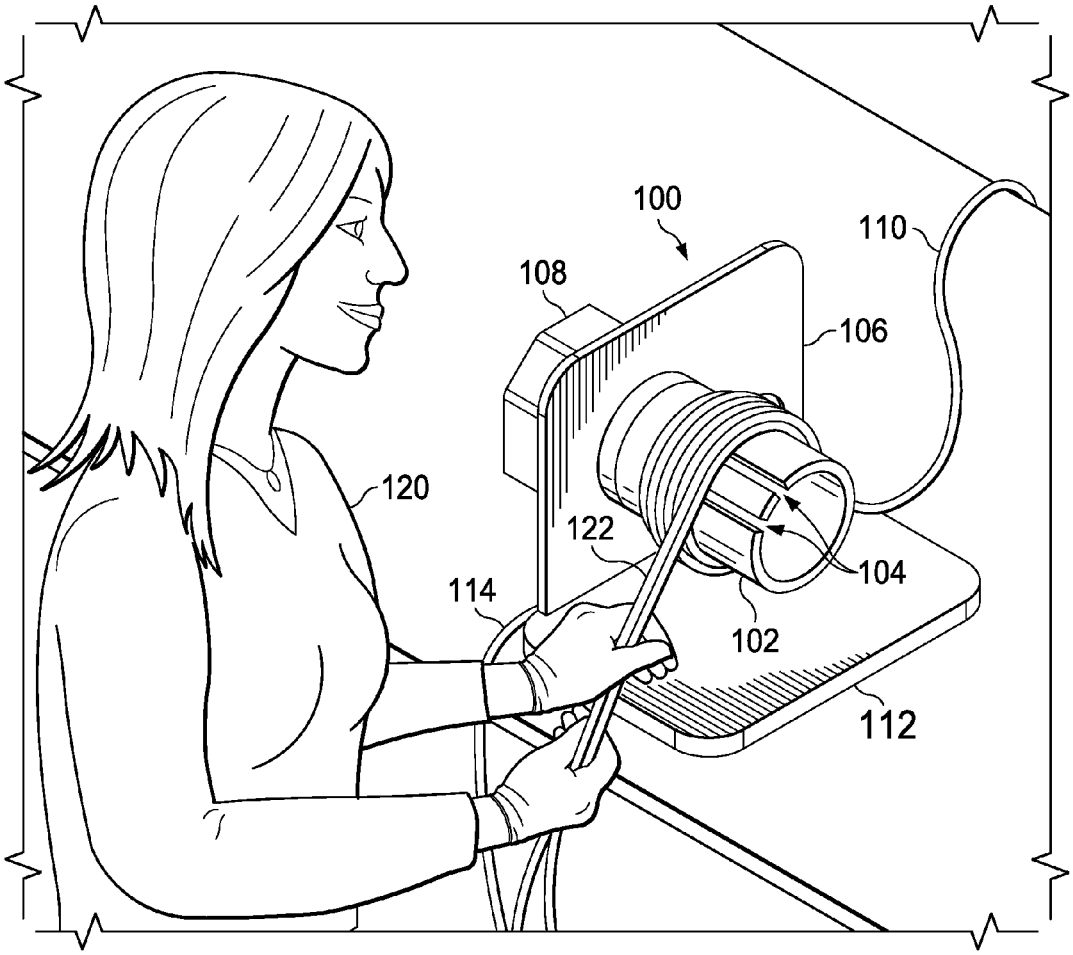
FIG. 2 is a pictorial representation of the wire wrapper of FIG. 1 in accordance with an illustrative embodiment.

In one embodiment, the drum 102 includes one or more slits 104. In the embodiment of FIGS. 1 and 2 the slits 104 are two slits 104 in the drum 102 that are slightly separated. In one embodiment, the middle of the wire may be inserted through the slits 104. For example, the middle of an Ethernet cable may be inserted through the slits 104 with the ends with RJ-45 heads extending from each of the slits 104. As a result, when the motor 108 is turned on, the wire may be wrapped from two ends. In another embodiment, a single end of the wire may be inserted through one of the slits 104 to wrap the wire around the drum 102 beginning at the single end. For example, the connector, inverter, transformer, or end of a wire may be inserted in the drum 102 with wire wrapping happening afterwards. The drum 102 may include an internal or external fastener for securing ends of the wire during rotation of the drum 102.

The slits 104 may also be configured to receive a tie wrap, Velcro connector, or twist tie for securing the wire while on the drum 102. The wire may be secured while still on the drum 102 to keep the wire closely bundled and fully secured. The drum 102 provides a uniform diameter for wrapping the wire providing consistent and predictable results. As a result, manufacturers, service providers, logistics companies, and other organizations may be able to provide predictably sized bundles of wires. Any of a number of drums may be selected and attached or integrated with the wire wrapper 100 to achieve a desired size of wire bundle. In one embodiment, the drum diameter may be 2.8" (near the motor) and taper down to 1.65" (at the open end). In another embodiment, the outside diameter of the drum 102 is approximately 2.5 inches for wrapping wires, such as 3-6 foot Ethernet cables.

Figure 3:
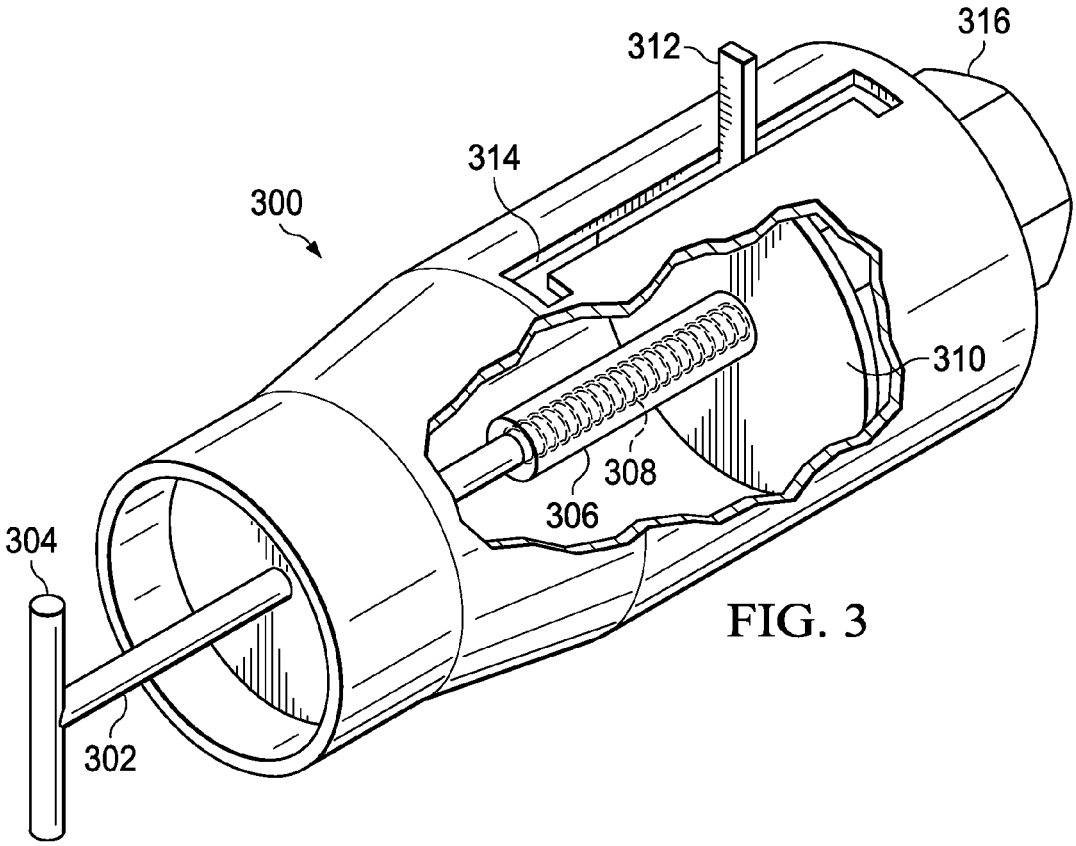
FIG. 3 is a pictorial representation of a drum of a wire wrapper in accordance with an illustrative embodiment.

In another embodiment, the drum 102 is not hollow, but instead includes a biased release for removing the wire. An example of such a drum 102 is shown in FIG. 3. The biased release may be utilized to remove or eject the wire from the drum 102.

FIG. 2 is a pictorial representation of the wire wrapper 100 of FIG. 1 in accordance with an illustrative embodiment. The wire wrapper of FIG. 2 shows an additional view of the wire wrapper 100 of FIG. 1 as well as a user 120 utilizing the wire wrapper 100. The user 120 may allow a wire 122 to slip through her hands during utilization of the wire wrapper 100. Once the user 120 is finished, the user may either manually, mechanically, or electrically slip the wire 122 off of the drum 102. The wire 122 may be removed before or after a tie is used to secure the wire 122. The drum 102 of FIG. 1

FIG. 3 is a pictorial representation of a drum 300 of a wire wrapper in accordance with an illustrative embodiment. The drum 300 shows an alternative embodiment for mechanically releasing a wire from the drum 300. The drum 300 is tapered for more easily removing the wire.

In one embodiment, the drum includes a release 302, a handle 304, a cylinder 306, a spring 308, a slide 310, a catch 312, a slit 314, and a nut 316. The release 302 includes a handle 304 that allows the user to insert, withdraw, and turn the release 302 with ease. The release 302 extends through the cylinder 306 and through the middle of the spring 308 at attaches to the slide 316 at the end opposite the handle 304. The slide 310 is configured to move back and forth within the drum 300 along the cylinder 306. The catch 312 extends from one end of the slide 310 through the slit 314 in the drum 300 and is configured to push the wire off of or substantially off of the drum 300. For example, the catch 312 may slide along a portion of the drum 300 pushing the wire, such that the wire is more easily removed due to the tapered shape of the drum 300. The height of the catch 312 may correspond to a length of wire wrapped around the drum 300 and typically extends 1-3", but may be shorter or longer depending on the type of wire being wrapped.

In one embodiment, the spring 308 is a tension spring that is attached to the slide 316 at a first end and to an end of the cylinder 306 at the second end. The spring 308 may bias the slide 310 toward the handle end of the drum 300 (open end). The nut 316 is configured to rotationally attach to the shaft of the motor. For example, the nut 316 may include threads that correspond to the shaft for rotationally attaching the nut 316. The nut 316 may include a port configured to receive a pin or locking member for securing the drum 300 to the shaft.

The slit 314 extends along a length of the drum 300 and is configured to move the catch 312 along the length of the slit 314. The handle 304 may allow the release 302 and the catch 312 to move between a wrapping position (when nearest the nut 316) and a release position (when the catch is near the open end of the drum 300). The spring 308 is biased or loaded when the catch 312 is moved to the wrapping position (the user pushes the handle in and turns it clockwise to engage the catch 312 in the slit 314). Once the handle 304 is turned counterclockwise, the wire pulls the catch 312 which slides the wire along the drum 300 to release the fully wrapped wire from the drum 300 of the wire wrapper.

Figure 4:
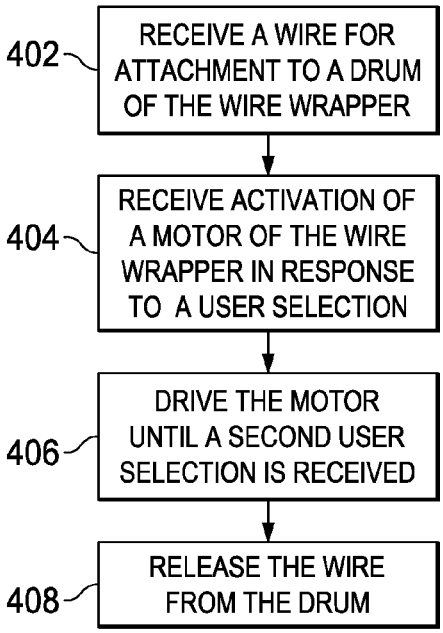
FIG. 4 is a flowchart of a process for utilizing a wire wrapper in accordance with an illustrative embodiment.

FIG. 4 is a flowchart of a process for utilizing a wire wrapper in accordance with an illustrative embodiment. The process of FIG. 4 may be implemented by a wire wrapper in response to user interaction and control.

The process begins with the wire wrapper receiving a wire for attachment to a drum of the wire wrapper (step 402). In one embodiment, the user slides the middle of the wire, in a loop, through slits of the drum. In another embodiment, a single end of the wire may be inserted through the slit or into the drum. In alternative embodiments, the wire wrapper may include a clip, clamp, or other securing mechanism for securing the middle or an end of the wire during the wrapping process.

Next, the wire wrapper receives activation of a motor of the wire wrapper in response to a user selection (step 404). In one embodiment, the user may turn on a power switch to the DC motor of the wire wrapper causing the motor and drum to rotate at a predefined RPM. For example, the user may activate the switch utilizing a foot pedal. In other embodiments, the user may utilize a hand dial, voice controls, or pressure switch to control the operation of the motor. In another embodiment, the motor may be variable speed and may rotate the motor and drum according to the ongoing and real-time selection of the user.

Next, the wire wrapper drives the motor until a second user selection is received (step 406). During the process of step 406, the motor drives the drum. The second user selection may be a second selection of the foot pedal with the power switch or turning the switch to an off position.

Next, the wire wrapper releases the wire from the drum (step 408). Once the drum has stopped rotating, the user may slide the wire off of the drum. In another embodiment, the wire wrapper may release the wire in response to a user twisting the handle to push the wire off of the drum. The wire wrapper may release the wire before or after a tie, wire, clip, ribbon, string, or other fixing component securing the wire wrapper in a bundle.

The previous detailed description is of a small number of embodiments for implementing the invention and is not intended to be limiting in scope. The following claims set forth a number of the embodiments of the invention disclosed with greater particularity.

What is claimed:

1. A wire wrapper, comprising:

a drum with a hollow internal cavity configured to rotate, wherein the drum includes:

a slit that extends along a length of the drum and has notches at each end of the slit, and a release mechanism that includes a biased catch disposed in the hollow internal cavity with a catch extension configured for sliding the wire toward an open end of the drum once the wire is wrapped, wherein the catch extension extends through the slit and can be rotated and locked into one of the notches, wherein the drum is selected from a plurality of interchangeable drums, the plurality of interchangeable drums having drums for different sizes of wires and for wrapping the wires into bundles of pre-defined diameters;

a motor configured to rotate the drum to wrap the wire around the drum; and a controller configured to start and stop the motor in response to user input.

2. The wire wrapper according to claim 1, wherein the controller is a foot petal configured to receive the user input.

3. The wire wrapper according to claim 1, wherein the drum is tapered for releasing the wire.

4. The wire wrapper according to claim 1, wherein the motor is a DC motor.

5. The wire wrapper according to claim 1, wherein the user input is received through a foot pedal including an on/off switch for turning the motor on and off.

6. The wire wrapper according to claim 1, wherein the controller is configured to provide variable power to drive the motor at variable speeds.

7. The wire wrapper according to claim 1, further comprising:

a support attached to the motor for stabilizing the motor during operation; and a base attached to the support for stabilizing the wire wrapper, wherein the support extends perpendicular to the base.

8. A wire wrapper, comprising:

a drum with a hollow internal cavity configured to rotate, wherein the drum includes:

a slit that extends along a length of the drum and has notches at each end of the slit, and a release mechanism that includes a biased catch disposed in the hollow internal cavity with a catch extension configured for sliding the wire toward an open end of the drum once the wire is wrapped, wherein the catch extension extends through the slit and can be rotated and locked into one of the notches, wherein the drum is selected from a plurality of interchangeable drums, the plurality of interchangeable drums having drums for different sizes of wires and for wrapping the wires into bundles of pre-defined diameters;

a motor configured to rotate the drum to wrap the wire around the drum; and a controller configured to start and stop the motor in response to a first user selection and a second user selection, respectively.

9. The wire wrapper according to claim 8, wherein the biased catch is biased by a tension spring and wherein the wire is slid toward the open end of the drum in response to a handle being turned.

10. The wire wrapper according to claim 8, wherein the motor is a DC motor, and wherein the drum is tapered for sliding the wire off of the drum.

11. The wire wrapper according to claim 8, wherein the first user selection and the second user selection are received through a foot pedal including an on/off switch for turning the motor on and off.

12. The wire wrapper according to claim 8, further comprising:

a support attached to the motor for stabilizing the motor during operation; and a base attached to the support for stabilizing the wire wrapper, wherein the support extends perpendicular to the base.

13. A method for wrapping a wire, the method comprising:

selecting a drum with a slit that extends along a length of the drum and has notches at each end of the slit, from a plurality of interchangeable drums, the plurality of interchangeable drums having drums for different sizes of wires and for wrapping the wires into bundles of pre-defined diameters;

locking a release mechanism, which includes a biased catch disposed in the hollow internal cavity with a catch extension configured for sliding the wire toward an open end of the drum once the wire is wrapped, by rotating the catch extension that extends through the slit into one of the notches;

receiving the wire to be wrapped along an outer surface of the drum;

receiving a first user selection to activate a motor attached to the drum;

rotating the drum;

stopping rotation of the drum in response to a second user selection.

14. The method according to claim 13, further comprising:

pushing the wire toward an open end of the drum utilizing the biased catch in response to receiving a user selection.

15. The method according to claim 13, wherein the first user selection and the second user selection are received through a foot pedal.

16. The method according to claim 13, wherein the motor is a DC motor, and wherein the first user selection and the second user selection are activation and deactivation of a power switch, respectively.

* * * * *